United States Patent [19]

Handschuch et al.

[11] 3,972,171

[45] Aug. 3, 1976

[54] HOUSING CONSTRUCTION FOR OPEN END SPINNING MACHINES

[75] Inventors: Karl Handschuch, Oberhaunstadt; Heinrich Niestroj, Ingolstadt, both of Germany

[73] Assignee: Schubert & Salzer Maschinenfabrik Aktiengesellschaft, Ingolstadt, Germany

[22] Filed: Oct. 7, 1974

[21] Appl. No.: 512,859

Related U.S. Application Data

[63] Continuation of Ser. No. 264,598, June 20, 1972, abandoned.

[30] Foreign Application Priority Data

June 21, 1971 Germany ..... 2130688

[52] U.S. Cl. ..... 57/58.89; 24/279; 57/100; 308/189 R

[51] Int. Cl.[2] ..... D01H 1/12

[58] Field of Search ..... 57/58.89–58.95, 57/100, 129, 130; 308/189 R; 248/74 B; 24/279, 280, 284

[56] References Cited

UNITED STATES PATENTS

| | | | |
|---|---|---|---|
| 1,767,429 | 6/1930 | Brittain, Jr. et al. | 308/189 R |
| 3,651,632 | 3/1972 | Shepherd | 57/58.95 |
| 3,756,007 | 9/1973 | Bartling | 57/58.91 |

*Primary Examiner*—Richard C. Queisser
*Assistant Examiner*—Charles Gorenstein
*Attorney, Agent, or Firm*—Robert W. Beach; R. M. Van Winkle

[57] ABSTRACT

One end of the housing for a spinning turbine is closed by a cover adjacent to the spinning cup mouth, which cover is connected with sliver-supply and yarn drawoff apparatus. The other housing end portion encircles a sleeve having bearings for the spinning cup shaft. Such shaft may be connected to drive means such as a belt or a commutatorless direct current motor, which drive means can be quickly disconnected. The sleeve-encircling housing portion includes quickly-releasable means for releasing the bearing sleeve for removal either alone or with attached drive means, and for replacement by a substitute bearing unit. The housing may have a longitudinal slit through a portion of its wall and cooperating lugs on each side of the slit for receiving nut and bolt means to clamp the split housing around the bearing sleeve. Alternatively, a set screw extends through the housing wall and bears on the sleeve to prevent sleeve movement. The sleeve may have a flange adjacent to the open housing end engageable by a pair of swingable leaf spring clips pivoted on the housing to draw the flange toward the housing. A split ring bushing may be interposed between the sleeve and the housing, and may include a collar for mounting the electronic control box for a motor.

2 Claims, 6 Drawing Figures

HOUSING CONSTRUCTION FOR OPEN END SPINNING MACHINES

This is a continuation of application Ser. No. 264,598, filed June 20, 1972, abandoned.

The present invention relates to the housing construction for open end spinning devices, which housing has a portion at the side of the spinning cup carrying the spinning shaft that is quickly releasable for removal and replacement of the shaft bearing unit. Such releasable housing portion holds the shaft bearing unit in place.

In one known type of open-end spinning device, the spinning chamber and the fiber-resolving device have separate housing units, but the housing unit for the resolving device forms the cover for the spinning chamber housing, as shown in German Offenlegungsschrift No. 1,535,005 and No. 1,815,776. However, the spinning chamber housing also forms the bearing for the spinning member, so that repair of damaged or worn bearing surfaces requires that the housing be dismantled. Unfortunately, because the cooperating resolving device housing forming the cover is connected in a manner that will not permit substitution of another spinning chamber, the entire spinning station must be shut down until repair or replacement of the bearings is completed, resulting in a substantial period of downtime and significant loss in productivity.

In another device disclosed in East German Pat. No. 67058, the spinning chamber and fiber-resolving device are housed in a common unit, so that even the simplest repairs require dismantling of the entire unit, resulting in excessive loss in maintenance downtime.

There are also spinning devices, such as shown in German Offenlegungsschrift No. 1,901,454 and No. 1,933,930, in which the spinning turbine is not enclosed by a housing unit. Such structures are particularly unsuited for easy maintenance, because the bearings cannot be readily removed and the low pressure conditions required for spinning must be created by especially high-speed rotation of the spinning turbine itself, rather than by evacuation of an enclosing housing.

It is the principal object of the present invention to provide a spinning turbine housing which enables the turbine bearing to be readily removed and replaced, or another bearing to be substituted, for prompt resumption of spinning.

Another important object is to provide readily replaceable bearing units for spinning devices having different forms of drive mechanism.

A further object is to be able to remove the bearing unit without disturbing the fiber-resolving and yarn drawoff fittings serving the spinning station.

An additional object is to provide a bushing adapter to permit use of different sizes of bearing sleeves in a particular housing.

The foregoing objects can be accomplished by a fixed housing portion enclosing a spinning cup having a cover pivotally mounted on the housing end adjacent to the spinning cup mouth, resiliently urged toward the housing and carrying fittings for fiber-resolving and yarn drawoff mechanism. The opposite housing end is open to permit insertion and removal of a sleeve having bearings for the spinning cup shaft. Such sleeve-receiving housing portion also carries clamping means to hold the bearing sleeve against both rotational and axial movement relative to the housing, which clamping means are quickly releasable for removing the bearing sleeve by sliding it axially out of the housing open end.

The spinning shaft may be driven by belt means engageable directly with such shaft or by an individual commutatorless direct current motor which is removable as a unit with the bearing sleeve. Bearing sleeves with different outside diameters may be substituted in a particular housing by provision of a resilient adapter bushing having an axial slit through its wall to cooperate with a correspondingly slit housing portion. Nut and bolt means spanning the housing slit clamp the housing around the bearing sleeve or its bushing. The use of an adapter bushing having a flange on its end remote from the spinning cup provides a mounting for an electronic control box for a commutatorless direct current motor. The bearing sleeve, bushing, motor and control box can be replaced as a unit to minimize resetting of the finely synchronized motor circuit. The control box is attached to the adapter bushing flange at a plurality of locations, all on one side of a diameter passing through the bushing slit, so that the bushing expandability and contractability is not substantially reduced.

Figure 1:
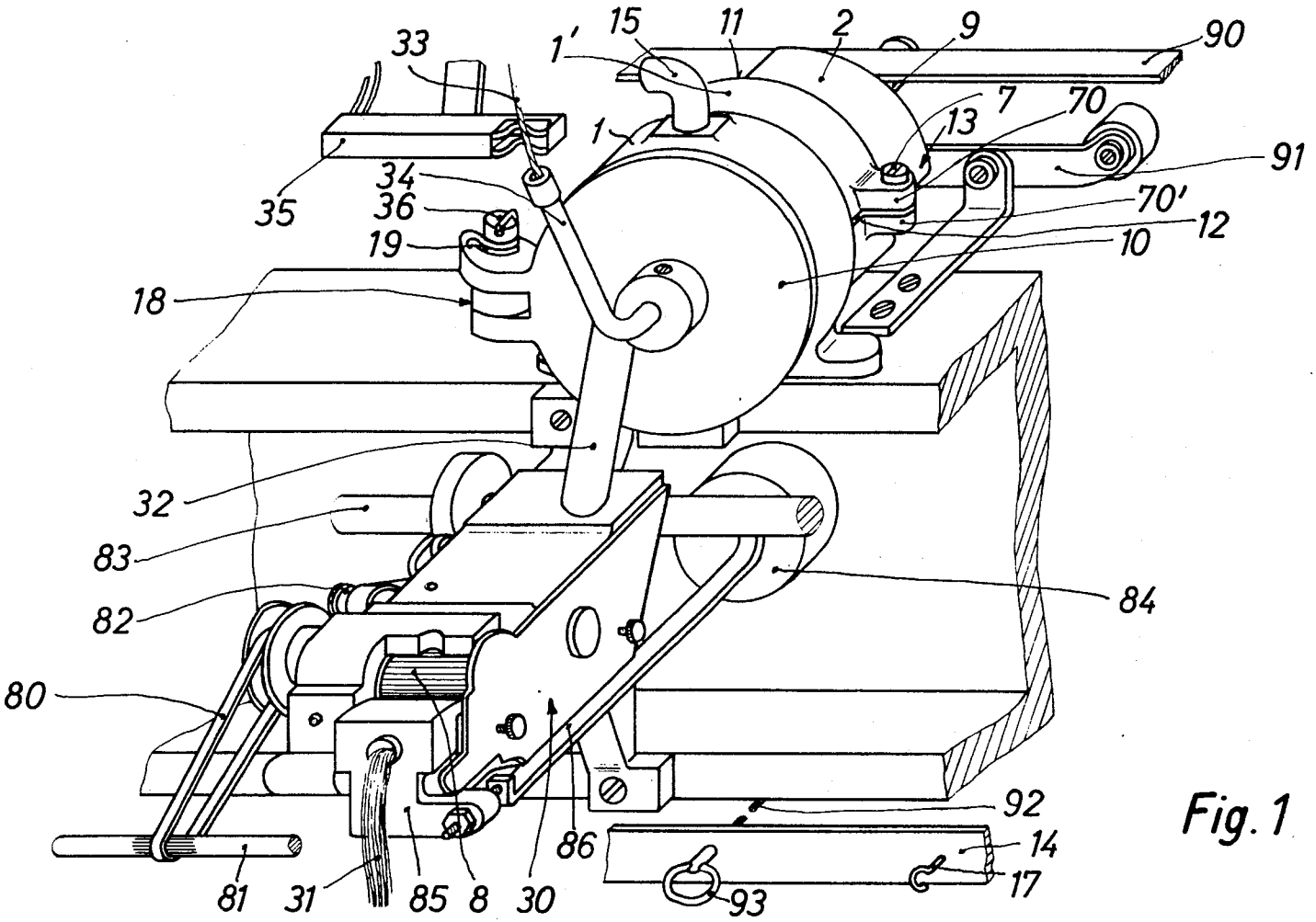
FIG. 1 is a top perspective of a spinning station having an open end spinning device according to the present invention, parts being broken away.

Because of the high productivity of each spinning station in an open end spinning machine, any malfunctioning which cannot be immediately detected and corrected results in substantial production losses.

Although it would be desirable to substitute replacement parts, this can be accomplished in conventional spinning devices only with difficulty and with relatively long periods of downtime, because disturbance of any components to make a substitution upsets fine adjustments of several interrelated parts of the apparatus. In order to reduce downtime to a minimum and thereby avoid such production losses, the end of housing 1 adjacent to the fiber-receiving spinning cup 3 is closed by a cover 10 and its opposite end 11 adjacent to the spinning shaft 37 is open. The bearings for shaft 37 are situated in a bearing sleeve 2, which is inactuable by axial movement into the housing open end 11. After bearing sleeve 2 is in place, it is clamped by clamping means carried on housing 1 to prevent relative movement between the housing and the sleeve, either axially or rotationally.

The preferred form of clamping means is shown in FIG. 1, in which the housing has a front portion 1 mounted on the machine frame adjacent to the cover 10 and a rear portion 1' having an axial slit 12 through its wall. Clamping means 13 for drawing the slit edges together around bearing sleeve 2 includes an upper lug 70 on housing portion 1' above slit 12 and a lower lug 70′ on such housing portion below the slit. Such lugs have bores therethrough aligned for receiving a bolt 7. The bore of lug 70′ may be tapped for belt 7, as that rotation of the belt in one direction or the other will loosen or tighten the housing portion 1′, respectively, around sleeve 2 without completely removing the belt.

Figure 2:
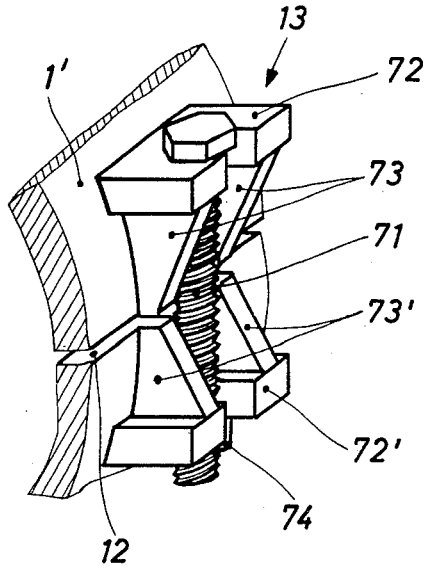
FIG. 2 is a fragmentary perspective of a portion of the spinning turbine housing showing modified clamping structures.

In FIG. 2, an alternative construction for clamping split housing portion 1′ is shown. Instead of lugs 70 and 70′, an upper plate 72 and a lower plate 72′ have slots in their edges for receiving a belt 71 carrying a lock nut 74. The belt can be set into the slots by radial movement, and then tightened, so that clamping of the housing portion 1′ can be effected with a single wrench, for example, to simplify the clamping operation and minimize the danger of dropping a loose nut. Clamping plates 72 and 72′ are spaced from the slit 12, and a pair of trapezoidal struts 73 and 73′ are provided for stiffening each plate on opposite sides of the belt-receiving slots.

Apart from the split housing and the removable bearing sleeve 2, the spinning apparatus shown in FIG. 1 is largely conventional. A spinning cup 5 having a shaft 4 is enclosed by the housing portion 1. Individual fibers are received by a resolving device 50 from a sliver 51 and supplied to the spinning cup through a fiber supply tube 52. The supply tube extends from the resolving device 50 through cover 10 to project tangentially of the fiber-collection surface of the spinning cup 3. A conduit 15 extends through the side of solid ring housing portion 2 by which the spinning chamber formed by the closed housing can be evacuated to provide the low pressure necessary to effect transport of fibers into the spinning cup. In a conventional manner, spun yarn 33 is removed from the spinning chamber through a drawoff tube extending concentrically through cover 10 by drawoff rollers not shown.

The sliver-supply roll 8 of the resolving device 30 is driven by a belt 80 connecting a sheave on the supply roll and a drive shaft 83. The resolving roller within the housing 50 is driven by a belt 82 connected to drive shaft 83. A sheave 9 on the end of spinning turbine shaft 4 is driven by a belt 90 from a remote drive motor (not shown).

If the bearings in bearing sleeve 2 become worn or must be removed for any other reason, the sleeve can be pulled axially from the housing opening 11 as a unit with shaft 37 and spinning cup 3 after the stretch of drive belt 90 engaging sheave 9, normally spring-pressed into the position shown in FIG. 1, is lifted by a roller on lever 91. Such lever is swung to raise the roller by pulling on a line 92 attached to the lever at the side of its pivot opposite the belt-engaging roller by grasping a ring 93 attached to the end of line 92 extending through machine frame member 14 at the front of the machine. Lever arm 91 will be held with the roller in its raised position by placing ring 93 on hook 17 fastened to frame member 14 and spaced from the frame aperture for line 92 a distance corresponding to the maximum swung position of lever 91.

If a yarn break had not occurred before the spinning turbine drive belt was disengaged, such disengagement will create such a break, and further fiber supply should be interrupted. A yarn tension sensing device 35 shown in FIG. 1 is responsive to a thread break and transmits a signal through amplifying means to energize an electromagnet 84 connected to a sliver clamp 85 by a plunger rod 86 to clamp the sliver and thereby prevent further sliver feed to the resolving roller. Consequently, by simply pulling ring 93 located at the front of the machine frame, the particular spinning station and its fiber supply are automatically stopped without affecting operation of other spinning stations operated by the same drive belt 90.

Figure 3:
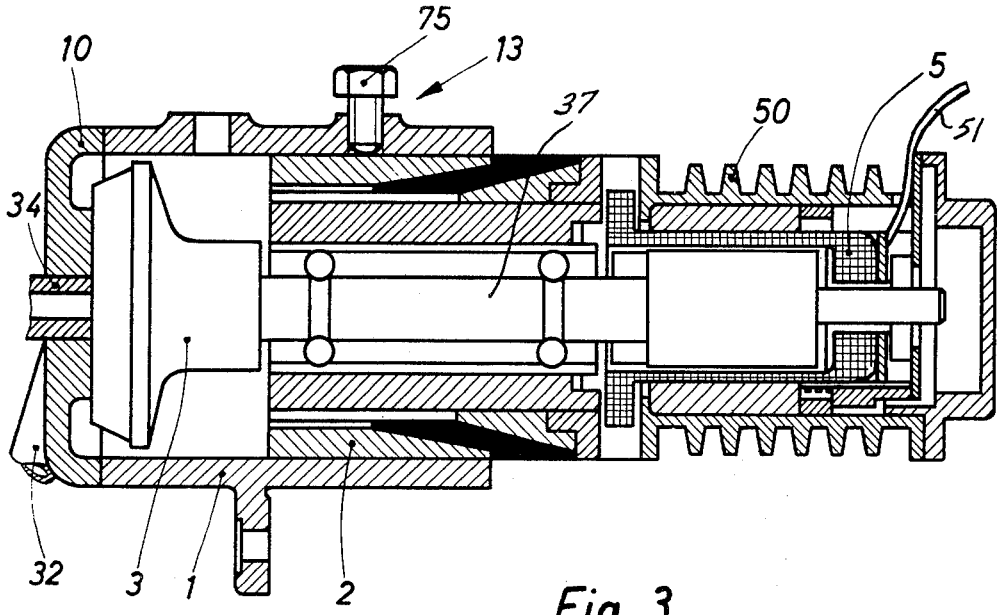
FIG. 3 is an axial section through a modified clamping housing and alternative drive means showing the spinning turbine in elevation.

In stopping the spinning station, the drive belt 90 is automatically lifted out of the way, so that bolt 7 can be loosened to release bearing sleeve 2, enabling such sleeve to be slid axially rearwardly through the open housing end 11 without interference by belt 90. A substitute bearing sleeve can then be slid axially into the housing, bolt 7 tightened, and ring 93 released from hook 17, lowering belt 90 to resume rotation of spinning shaft 4. The split ring housing construction of FIGS. 1 and 2 provides a very effective radial clamp for sleeve 2. Alternatively, as shown in FIG. 3, the bearing sleeve can be held in place by clamping means 13 consisting of a solid ring housing 1 having a bore through its side near the opening 11 through which a setscrew 75 projects to bear on the side of bearing sleeve 2. This construction again permits bearing-clamping engagement and release simply by turning a screw, as in the clamping devices of FIGS. 1 and 2, although in the preferred forms of those figures the clamping pressure is uniformly distributed around the circumference of the sleeve.

Figure 4:
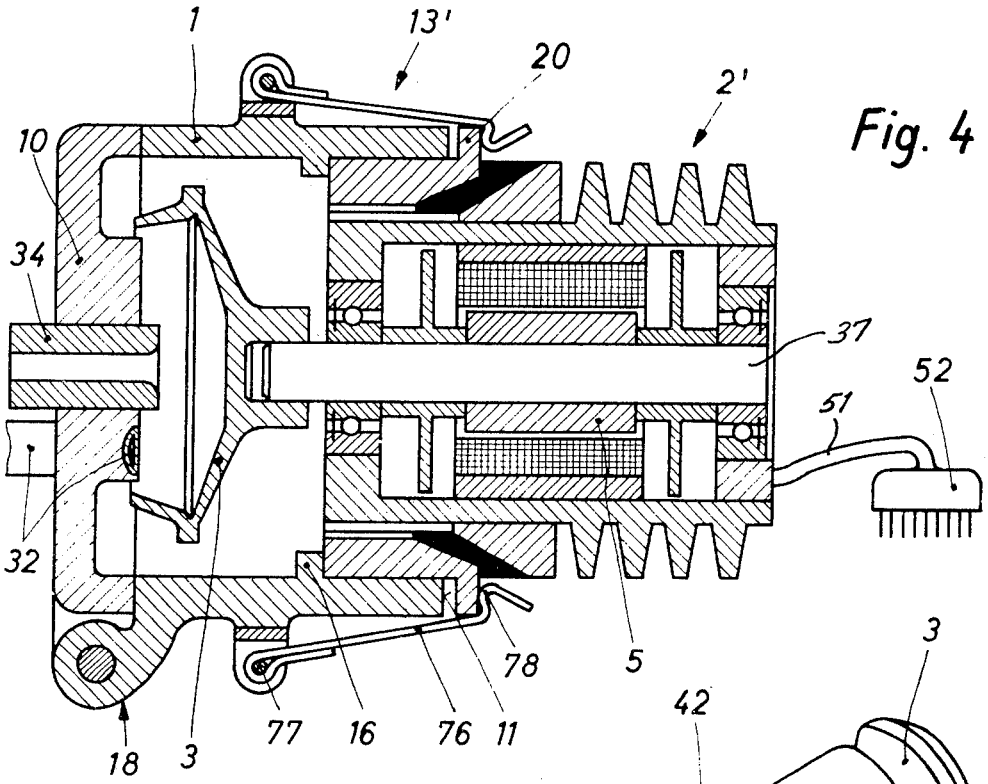
FIG. 4 is an axial section through the spinning turbine housing showing alternative clamping means and modified drive means.
Figure 6:
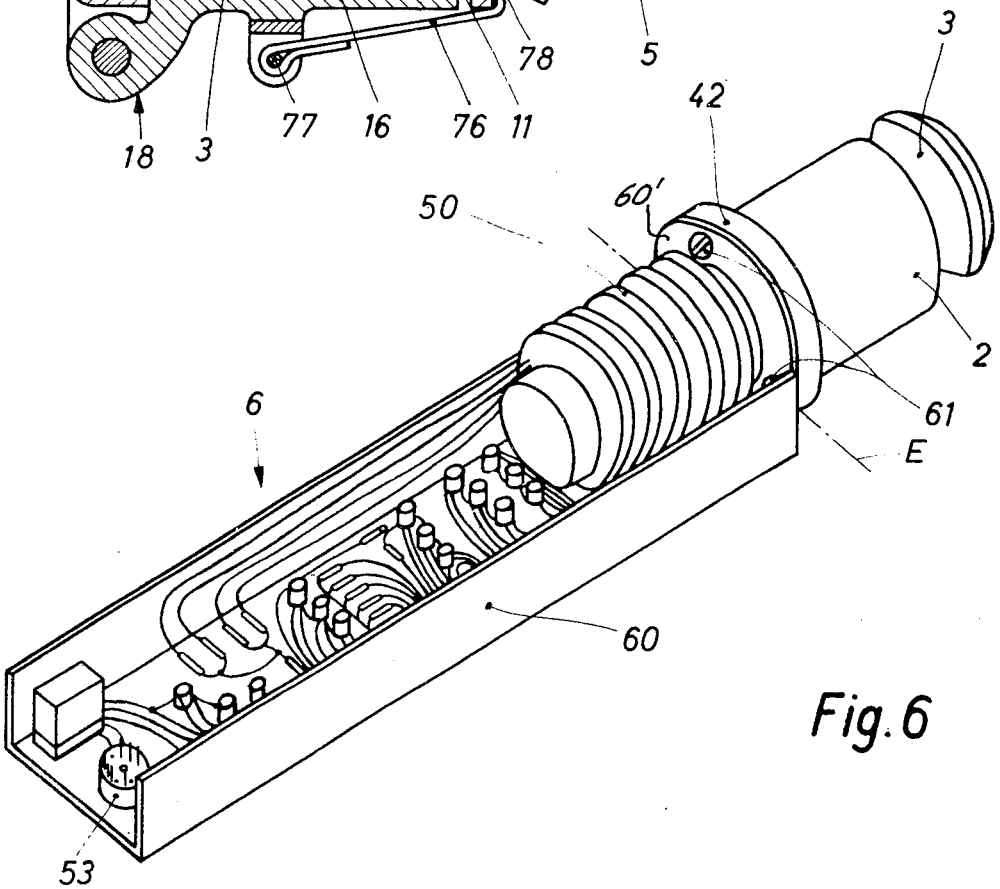
FIG. 6 is a top perspective showing one application of the adapter bushing to a spinning turbine driven by an electronically-controlled direct current motor.

If desired, the sleeve can be held positively against axial movement by the clamping means shown in FIG. 4. The housing portion 1 includes an internal annular rib 16 forming a shoulder against which the end of bearing sleeve 2′ abuts. Such sleeve has an external flange 20 which is located close to the end 11 of the housing when the sleeve bears against internal rib 16. The clamping means 13′ includes a plurality of equidistantly circumferentially spaced leaf springs 76, each having one end connected to ears on the housing exterior by pivots 77. The opposite end of each leaf spring has a hook 78 engaging the flange 20. To release bearing sleeve 2′, the hooks 78 of spring clips 76 can be pulled off flange 20.

Figure 5:
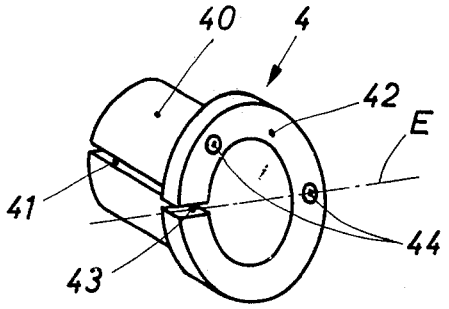
FIG. 5 is a top perspective of an adapter bushing for use with the present invention.

Greater substitution flexibility can be achieved by providing an adapter bushing to permit use of bearing sleeves having a smaller outside diameter than the inside diameter of housing 1. Such an adapter is shown in FIG. 5, which is especially suitable for use with the split ring housing construction shown in FIG. 1. The bushing body 40 is a cylindrical tube having an axial slit 41 through its circumference. Such an adapter bushing can be more positively positioned and can be used for mounting auxiliary parts, as described further below, if it is provided with an external flange 42 on one end, which flange is also slit at 43 in extension of the body slit 41. Such a split ring adapter will coincidentally expand and contract in response to loosening or tightening, respectively, of the clamping means 13 shown in FIG. 1 or FIG. 2.

As described previously, the spinning shafts of individual spinning stations can be driven by a common drive belt 90. In FIGS. 3 and 4, each spinning station is shown as having its own commutatorless direct current motor 5. In FIG. 3, such motor is contained in a housing sleeve 50 which is connected directly to bearing sleeve 2 to eliminate expensive couplings. In the construction shown in FIG. 3, the ends of sleeves 2 and 50 are complementally flanged to form an axial lop joint. A more compact arrangement is shown in FIG. 4, in which the motor 5 is located within sleeve 2′ concentrically encircling shaft 37, so that the motor shaft is the spinning shaft.

The direct current motor 5 is driven by an electronic control requiring a plurality of connections for the motor stator. The loads for such connections can be conveniently gathered into a cable 51. To avoid the necessity of individually connecting each load during exchange of bearing sleeves, it is preferred that a multiple-prong plug 52 be provided for connection with a complemental jack on the electronic control beard.

In order to avoid dissipation of high frequency current in the leads, they should be kept as short as possible. Also, if the bearing sleeve 2 or 2' and the motor 5 are disconnected during exchange of the bearing sleeves, the electronic connections must be readjusted. This readjustment can be done away from the machine if the bearing sleeve 2, motor 5 and the electronic control 6 for the motor can be removed from, and inserted into, the spinning station as a single unit. For this purpose, an adapter bushing of the type shown in FIG. 5 can be used, in which the flange 42 of the bushing provides a mounting for the control box 60. Such control box contains the entire electronic control, which includes a multiple-prong plug 53 for connection to the current supply. To prevent loss of resilience of the adaptor by connection of the control box mounting collar 60' with flange 42, the connection is made at a plurality of locations on one side of a diametral line E, passing through the slit 41, 43. Consequently, two tapped holes 44 in flange 42 are shown in FIG. 5, with one hole located diametrically opposite the slit 43, and the other located in the semicircular portion above diameter line E, but spaced more than 90° from the first hole to provide maximum resistance to twisting of the box 60. Control box collar 60' has holes corresponding to adapter holes 44 to receive connecting screws 61.

It is preferred that the cover 10 be hingedly connected to housing 1, rather than completely removable, to minimize readjustment of the fiber feed and yarn drawoff means, for example, after the cover has been opened, such as for cleaning the spinning chamber and cup. A particularly suitable hinge connection for this purpose is shown in FIGS. 1 and 4. As shown in FIG. 1, the hinge joint 18 includes two spaced ears projecting from cover 10 embracing a central ear projecting from housing 1. A hinge pin 36 is fixed in the housing ear, so that such pin cannot turn relative to the housing. A spiral spring 19 has one end connected to the upper ear of swingable cover 10 and the other end connected to the stationary pin 36, so that the cover is normally held in its closed position.

To open the cover, drawoff tube 34 may serve as a handle for swinging the door to the left, as seen in FIG. 1. Such a hinged cover permits access to the inner end of bearing sleeve 2 or 2', if, after release of the clamp 13, frictional engagement of the housing and sleeve is sufficient to require an additional push to remove the sleeve from the rear of the housing. In addition, the interior of the spinning housing is readily accessible for cleaning during any temporary stoppage of the station, or to remedy other spinning problems when it is unnecessary to remove the bearing sleeve 2 or 2' for repair or replacement.

As seen in FIG. 1, cover 20 swings about an axis perpendicular to the cover of resolving device 30, so that the outer end of supply tube 32 can simply slide along such cover out of alignment with the fiber supply opening in such cover. When cover 20 is again closed, tube 32 will slide back into alignment with the fiber supply opening for channeling fiber into the spinning chamber. For this purpose, it is both undesirable and unnecessary for the resolving device 30 and the adjacent end of tube 32 to be connected to each other in any manner.

We claim:

1. In an open-end spinning machine having a spinning turbine including a spinning shaft, a tubular housing receiving the spinning turbine, a cover on one end of the housing including a fiber-supply channel connecting a fiber-resolving device externally of the housing and the housing interior, and a yarn drawoff tube in the cover, the housing having an open end remote from the cover, the diameter of said opening being greater than the diameter of the spinning turbine, said housing further having a first portion adjacent to the cover receiving the spinning turbine and a second portion remote from said cover and connected to said first portion, a bearing sleeve having bearings for the spinning shaft and fitting into said open housing end and embraced by said second portion, and tightening means carried on such second portion, the improvement comprising an adapter bushing interposed between said second housing portion and the bearing sleeve and being secured in said second portion of said housing by said tightening means, said bushing having an axial slit through its wall extending the entire length of such wall, and an individual commutator direct current motor for driving the spinning shaft, said bushing further having a circumferential flange on one end exteriorly of the open housing end, and an electronic motor control container carried by an arcuate portion of said adapter bushing flange at one side of the flange diametral line passing through the bushing slit.

2. The spinning machine defined in claim 1, and multiple-prong plug means for connecting the electronic motor control with an electric current supply.

* * * * *